US008667724B2

(12) United States Patent
Zheng

(10) Patent No.: US 8,667,724 B2
(45) Date of Patent: Mar. 11, 2014

(54) SELF-LEVERING FOLLOWER FOR A UNIVERSAL MAGAZINE OF MULTIPLE CALIBER COMPATIBILITY FOR FIREARMS

(71) Applicant: Jing Zheng, El Paso, TX (US)

(72) Inventor: Jing Zheng, El Paso, TX (US)

( * ) Notice: Subject to any disclaimer, the term of this patent is extended or adjusted under 35 U.S.C. 154(b) by 0 days.

(21) Appl. No.: 13/731,037

(22) Filed: Dec. 30, 2012

(65) Prior Publication Data

US 2013/0167420 A1 Jul. 4, 2013

Related U.S. Application Data

(60) Provisional application No. 61/582,205, filed on Dec. 30, 2011.

(51) Int. Cl.
*F41A 9/70* (2006.01)

(52) U.S. Cl.
USPC ..... 42/50

(58) Field of Classification Search
USPC ..... 42/50, 49.02, 49.01
See application file for complete search history.

(56) References Cited

U.S. PATENT DOCUMENTS

| | | | | |
|---|---|---|---|---|
| 2,441,735 | A * | 5/1948 | Warner | 42/50 |
| 4,446,645 | A * | 5/1984 | Kelsey et al. | 42/50 |
| 6,560,907 | B1 * | 5/2003 | Vieweg | 42/50 |
| 7,530,191 | B2 * | 5/2009 | Szabo | 42/50 |
| 2011/0173856 | A1 * | 7/2011 | McCormick | 42/50 |

* cited by examiner

*Primary Examiner* — Michael Carone
*Assistant Examiner* — Reginald Tillman, Jr.
(74) *Attorney, Agent, or Firm* — Han IP Corporation; Andy M. Han

(57) ABSTRACT

A magazine for a firearm comprises a magazine shell, a main magazine spring, and a follower assembly. The follower assembly is disposed inside the magazine shell and movable generally along a longitudinal axis of the magazine shell. The follower assembly includes a non-tilt-able piece coupled to a first end of the main magazine spring and having a first end and a second end opposite the first end. The follower assembly also includes a tilt-able piece having a first end and a second end opposite the first end. A middle portion of the tilt-able piece is pivot-ably coupled to a middle portion of the non-tilt-able piece. The follower assembly further includes an elastic element that is elastically disposed between the non-tilt-able piece and the tilt-able piece and exerting a force on the non-tilt-able piece and the tilt-able piece.

15 Claims, 9 Drawing Sheets

SELF-LEVERING FOLLOWER FOR A UNIVERSAL MAGAZINE OF MULTIPLE CALIBER COMPATIBILITY FOR FIREARMS

CROSS-REFERENCE TO RELATED APPLICATIONS

This application claims the priority benefit of U.S. patent application No. 61/582,205, entitled "A Universal Magazine of Multiple Caliber Compatibility for Firearms" and filed on Dec. 30, 2011. The entirety of the above-identified patent application is hereby incorporated by reference and made a part of this specification.

BACKGROUND

1. Technical Field

The present disclosure generally relates to firearms. More specifically, the present disclosure relates to a magazine for firearms.

2. Description of Related Art

In the context of firearms, a magazine is an ammunition storage and feeding device within or attached to a repeating firearm. The magazine functions by moving the ammunition cartridges stored in the magazine into a position where the cartridges are loaded into the chamber of the firearm. In order for fresh rounds of ammunition to be reloaded to the firearm reliably, each ammunition cartridge needs to be in a specific angle and position aligned with the firearm barrel so that it can be rammed into the barrel by the firearm action devices, e.g., the rifle bolt or handgun slides. To ensure such feeding process proceeds smoothly, the firearm magazine is designed to provide each round of ammunition with full support within the magazine. Typically, a spring inside the magazine pushes the ammunition against the magazine lip securely so that the ammunition will align axially with the barrel at the designed angle and position.

For the ease of ejection after firing, ammunition cartridges, especially rifle cartridges, have various tapering design on the casing. Due to the material used for the casing, some ammunition cartridges have larger tapering angle than others. There is one dubbed as 7.62×39, also known as M43 or 762 Russian, which has one of the largest case tapering. Another popular caliber, which is dubbed as 223 Remington, has one of the smallest case tapering. The casing of the M43 ammunition and the casing of the 223 Remington ammunition have different tapering angles. The M43 ammunition cartridges are typically stacked inside a magazine in order to maintain full support of each ammunition cartridge. The 223 Remington ammunition cartridges are typically stacked inside a magazine in order to maintain full support of each ammunition cartridge. Given the tapering angle of the casing, the stack of M43 ammunition cartridges and the stack of 223 Remington ammunition cartridges appear to have a "bent" shape although the stack of M43 ammunition cartridges has a more pronounced "bent" shape given the relatively larger tapering angle of the M43 ammunition casing. Accordingly, the design of the magazine may need to adopt the "bent" shape. An AK style magazine is typically a banana shaped magazine. There is, however, one disadvantage associated with this kind magazine. As the whole magazine has a banana shape, it has to be mounted onto a firearm with a rotational action. As a result, it is not easy to drop such a magazine by its own weight when the magazine is empty.

On the contrary, rifles such as AR15 use a STANAG magazine that utilizes a straight-bent-straight design so that the end that has the feeding lip has a straight potion and can be inserted into the rifle's straight magazine wall. When the magazine catch is released, the magazine can be dropped out of the rifle by its own weight. This allows the firearm operator to insert a loaded magazine back into the firearm with relatively less time compared to the case with the AK47 style magazine. Although the time difference may be seconds or fractions of a second, such time difference could mean a difference of life and death in the battle field.

However, such straight-bent-straight design has a potential problem. Since the ammunition has a tapered casing (albeit small), individual ammunition cartridges could be separated from one another as the ammunition cartridges are stacked into columns inside the straight potion of the magazine. For example, when stacked in the STANAG magazine, the M43 ammunition cartridges and the 223 Remington ammunition cartridges could be separated from one another at the neck area, while being in contact with one another at the tail area. This kind of freedom in movement may cause the ammunition cartridges to be jammed inside of the magazine and stop the firearm from continuous firing. For AR15 rifles, the standard ammunition used has a very small tapering on its casing. Together with the clearance tolerance between the magazine wall and the follower, the follower can be tilted slightly to compensate for the ammunition tapering effect described above. However, such tilting can only be allowed in a very small scale because excessive follower tilt in itself can introduce jam inside the magazine. In fact, some non-tilting follower designs are in place specifically to limit the excessive tilt of the follower.

As AR15 rifles are among the most popular rifles in the civilian market, ammunition cartridges of different calibers are available for the AR15 rifles. Consequently, ammunition cartridges with casings of various tapering angles have to cope with the straight magazine wall design of the AR15 rifle. Those ammunition cartridges with casing of smaller tapering tend to easily adapt to the AR15, also known as STANAG, standard shaped magazine. However, for ammunition cartridges with casing of larger tapering, a user may have trouble in finding reliable magazines, especially for large capacity magazines. Among those, the casing of M43 has one of the biggest tapering angles. It is the standard ammunition for AK47 and its military surplus is abundant. There are some AR15 rifles manufactured in this caliber. However, due to its large tapering on the casing, large capacity magazines are hardly available.

This dilemma may, to some degree, be addressed by either of a couple of approaches. As a first, do-it-yourself approach, one may weld two halves of a magazine together, with the upper half being from a STANAG standard magazine and the bottom half being from an AK47 banana shaped magazine. As a second approach, a commercially-available new magazine has been developed based on the above-mentioned idea. This perhaps is the most reliable magazine for the AR15 rifles in the 7.62×39 caliber. However, since the follower of this magazine is the same non-tilting design used in the standard STANAG magazine, the ammunition cartridges within the straight-wall portion of the magazine are still not fully supported. Hence, in some circumstances, such as shooting when moving or shooting on a moving platform, the extra momentum created by the motion might tilt the ammunition slightly with the ammunition head pointing down and cause the firearm to jam.

SUMMARY

The present disclosure is directed to self-levering follower assembly for a universal magazine with multiple caliber compatibility and straight magazine wall.

According to one aspect, a self-levering follower assembly for a magazine of a firearm may be disposed inside a magazine shell of the magazine and movable generally along a longitudinal axis of the magazine shell. The follower assembly may comprise a first piece, a second piece, and an elastic element. The first piece may be configured to be coupled to an end of a main magazine spring of the magazine. The first piece may include a first end and a second end opposite the first end. The second piece may include a first end and a second end opposite the first end. A middle portion of the second piece may be pivot-ably coupled to a middle portion of the first piece. The elastic element may be elastically disposed between the first piece and the second piece and exerting a first force on the first piece and the second piece. When the magazine shell holds no ammunition cartridge therein, the first end of the first piece and the first end of the second piece may be in contact while the second end of the first piece and the second end of the second piece may be separated due to the first force exerted by the elastic element. When the magazine shell holds one or more ammunition cartridges therein with the one or more ammunition cartridges disposed on the second piece, the first end of the first piece and the first end of the second piece may be either in contact or separated while the one or more ammunition cartridges compress the main magazine spring to exert a second force against the first force exerted by the elastic element.

In at least one embodiment, the second end of the second piece may include a protrusion such that the protrusion engages with a bolt catch of the firearm due to the first force exerted by the elastic element and the second force exerted by the magazine main spring when the magazine shell holds no ammunition cartridge therein.

In at least one embodiment, the second end of the first piece may include a protrusion such that the protrusion engages with a bolt catch of the firearm due to the second force exerted by the magazine main spring when the magazine shell holds no ammunition cartridge therein.

In at least one embodiment, the elastic element comprises a compression spring.

In at least one embodiment, the first piece may include a pocket portion that receives a first end of the compression spring, and the second piece may include a spring guide protrusion to which a second end of the compression spring opposite the first end of the compression spring is coupled.

In at least one embodiment, the elastic element may comprise a torsion spring.

In at least one embodiment, the first piece may include a recess that receives a first portion of the torsion spring, and the second piece may include a recess that receives a second portion of the torsion spring.

According to another aspect, a magazine of a firearm may comprise a magazine shell, a main magazine spring, and a self-levering follower assembly. The magazine shell may include a first end, a second end opposite the first end, and sidewalls between the first end and the second end. The first end of the magazine shell may include an opening and may be configured to attach to the firearm. The second end of the magazine shell may include a bottom plate. The main magazine spring may include a first end and a second end opposite the first end. The second end of the main magazine spring may be coupled to the bottom plate of the second end of the magazine shell. The self-levering follower assembly may be disposed inside the magazine shell and movable generally along a longitudinal axis of the magazine shell. The self-levering follower assembly may comprise a first piece, a second piece, and an elastic element. The first piece may be coupled to the first end of the main magazine spring. The first piece may include a first end and a second end opposite the first end. The second piece may include a first end and a second end opposite the first end. A middle portion of the second piece may be pivot-ably coupled to a middle portion of the first piece. The elastic element may be elastically disposed between the first piece and the second piece and exerting a first force on the first piece and the second piece.

In at least one embodiment, when the magazine shell holds no ammunition cartridge therein, the first end of the first piece and the first end of the second piece may be in contact while the second end of the first piece and the second end of the second piece may be separated due to the first force exerted by the elastic element. When the magazine shell holds one or more ammunition cartridges therein with the one or more ammunition cartridges disposed on the second piece, the first end of the first piece and the first end of the second piece may be either in contact or separated while the one or more ammunition cartridges compress the magazine main spring to exert a second force against the first force exerted by the elastic element.

In at least one embodiment, the second end of the second piece may include a protrusion such that the protrusion engages with a bolt catch of the firearm due to the first force exerted by the elastic element and the second force exerted by the main magazine spring when the magazine shell holds no ammunition cartridge therein.

In at least one embodiment, the second end of the first piece may include a protrusion such that the protrusion engages with a bolt catch of the firearm due to the second force exerted by the magazine main spring when the magazine shell holds no ammunition cartridge therein.

In at least one embodiment, the elastic element may comprise a compression spring.

In at least one embodiment, the first piece may include a pocket portion that receives a first end of the compression spring, and the second piece may include a spring guide protrusion to which a second end of the compression spring opposite the first end of the compression spring is coupled.

In at least one embodiment, the elastic element may comprise a torsion spring.

In at least one embodiment, the first piece may include a recess that receives a first portion of the torsion spring, and wherein the second piece includes a recess that receives a second portion of the torsion spring.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Overview

Figure 1:
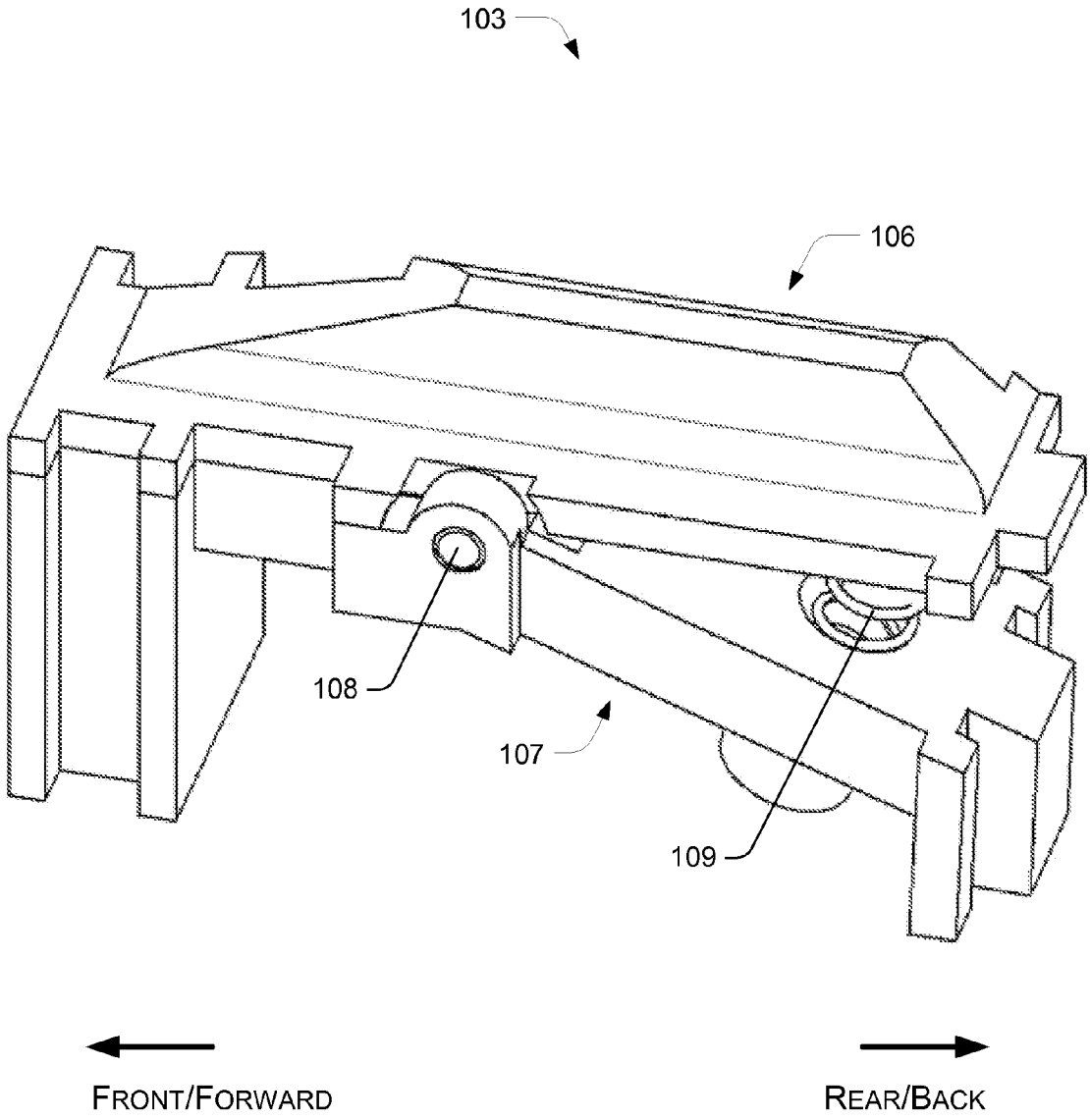
FIG. 1 is an assembly view of a tilt-able self-levering follower assembly of a universal magazine in accordance with an embodiment of the present disclosure.

Various embodiments of the present disclosure relate to a self-levering follower for a universal magazine for firearms, such as rifles, that have straight magazine wall. The universal magazine can accommodate ammunition cartridges of various calibers. More specifically, the universal magazine can reliably feed ammunition cartridges into a rifle chamber regardless of the caliber of the ammunition cartridges as long as the ammunition cartridges can fit in the universal magazine. The universal magazine may include a tilt-able self-levering follower assembly.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

Exemplary Embodiments of Follower Assembly

Figure 2:
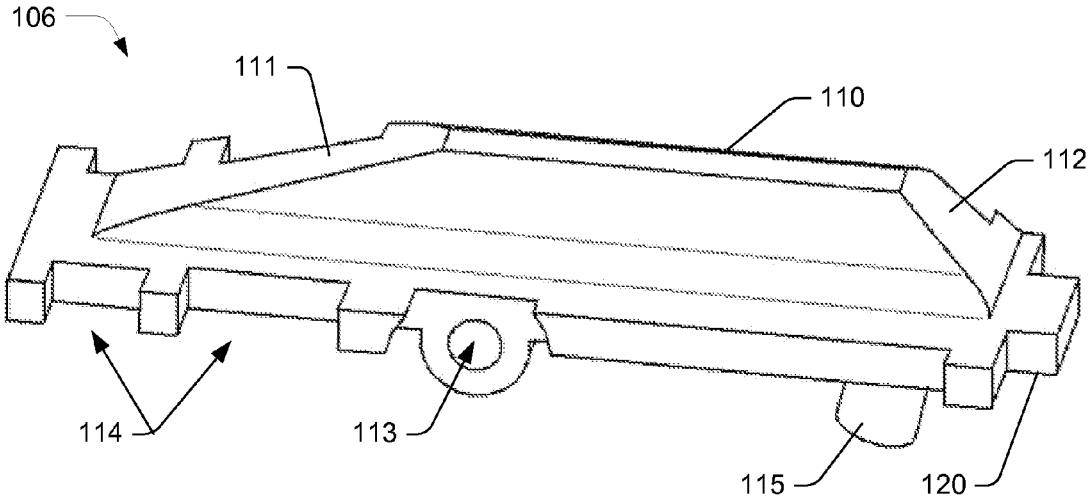
FIG. 2 is a perspective view of a tilt-able piece of the tilt-able self-levering follower assembly of FIG. 1 in accordance with an embodiment of the present disclosure.
Figure 3:
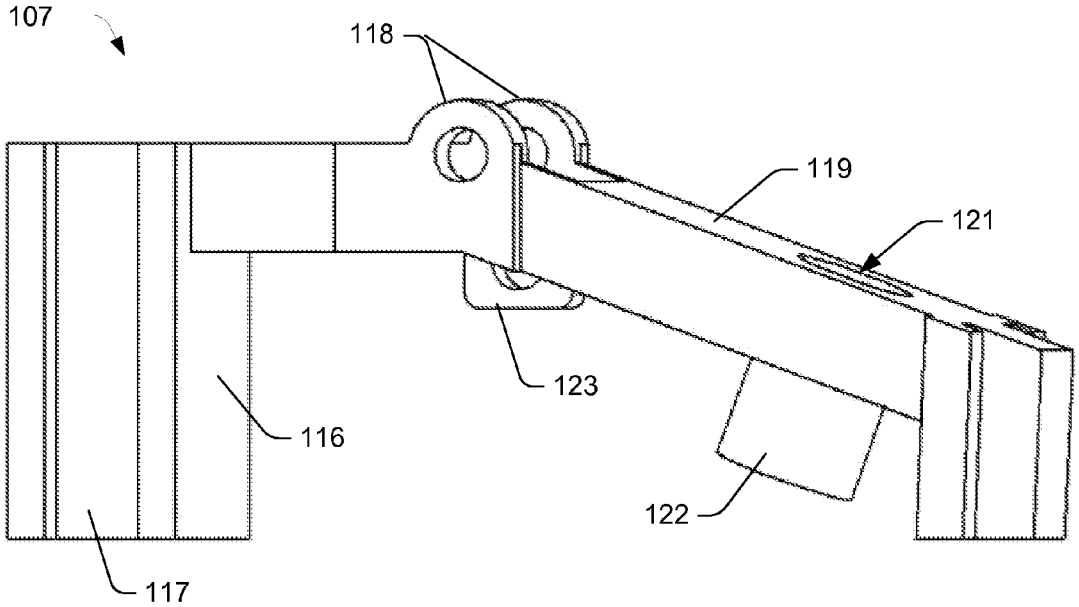
FIG. 3 is a perspective view of a non-tilt-able piece of the tilt-able self-levering follower assembly of FIG. 1 in accordance with an embodiment of the present disclosure.
Figure 4:
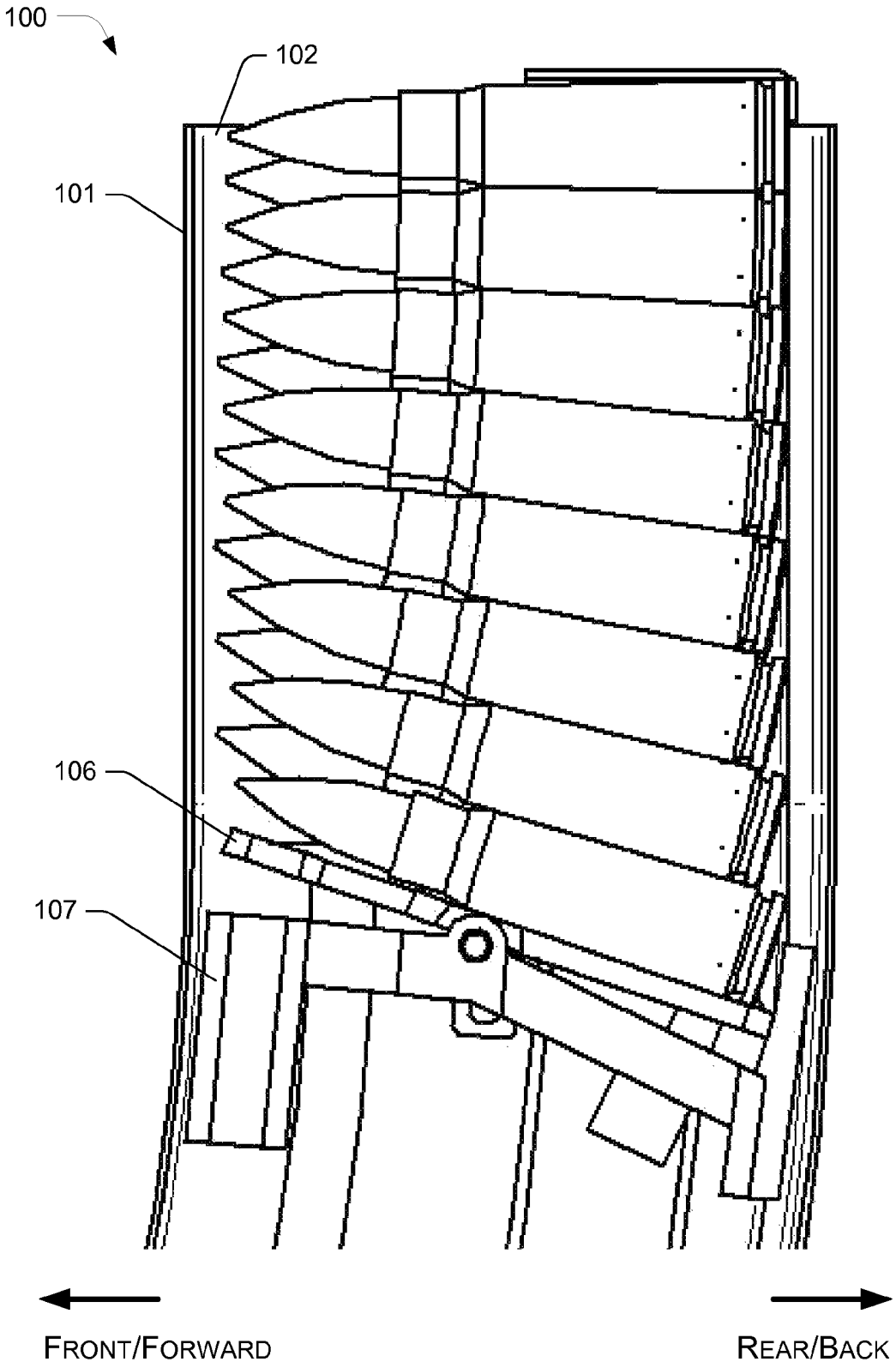
FIG. 4 is a cut-away view of a stack of M43 ammunition cartridges supported in a straight-wall portion of the universal magazine in accordance with an embodiment of the present disclosure.

FIG. 1 illustrates a tilt-able self-levering follower assembly 103 of a universal magazine 100 (shown in FIG. 4) according to a first embodiment. FIG. 2 illustrates a tilt-able second piece 106 of the tilt-able self-levering follower assembly 103 of FIG. 1. FIG. 3 illustrates a non-tilt-able first piece 107 of the tilt-able self-levering follower assembly 103 of FIG. 1. FIG. 4 illustrates a cut-away view of a stack of M43 ammunition cartridges supported in a straight-wall portion of a universal magazine 100 in accordance with an embodiment of the present disclosure.

The tilt-able self-levering follower assembly 103 is disposed inside a magazine shell 101 of the universal magazine 100 when assembled, and is movable generally along a longitudinal axis of the magazine shell 101, e.g., up and down between the first end and the second end of the magazine shell 101. Compared with conventional approaches that adopt a one-piece design, the tilt-able self-levering follower assembly 103 has a two-piece design having a non-tilt-able piece and a tilt-able piece. As shown in FIG. 1, the tilt-able self-levering follower assembly 103 includes a first piece 107 and a second piece 106. The first piece 107 is a non-tilt-able piece and the second piece 106 is a tilt-able piece. The present disclosure provides a number of embodiments of the tilt-able self-levering follower assembly 103, as described below.

The first piece 107 has a first end and a second end opposite the first end. For example, the first end of the first piece 107 may be the end that is towards the front of the universal magazine 100 when assembled, and the second end of the first piece 107 may be the end that is towards the rear of the universal magazine 100 when assembled. The first piece 107 is coupled to an end of a main magazine spring of the universal magazine 100. The second piece 106 has a first end and a second end opposite the first end. For example, the first end of the second piece 106 may be the end that is towards the front of the universal magazine 100 when assembled, and the second end of the second piece 106 may be the end that is towards the rear of the universal magazine 100 when assembled. A middle portion of the second piece 106 is pivot-ably coupled to a middle portion of the first piece 107. In at least one implementation, the middle portion of the first piece 107 and the middle portion of the second piece 106 are connected through a hinge pin 108, as shown in FIG. 1. In other embodiments, the first piece 107 and the second piece 106 may be pivot-ably coupled to one another without a separate pin like the hinge pin 108. For example, the second piece 106 may have pillar-shaped protrusions on its bottom side that goes through the hinge plates 118 of the first piece 107 so that the second piece 106 and the first piece 107 may be pivot-ably coupled to one another.

The tilt-able self-levering follower assembly 103 further includes an elastic element 109. The elastic element 109 is elastically disposed between the first piece 107 and the second piece 106 and exerts a first force on the first piece 107 and the second piece 106. As such, when the magazine shell 101 holds no ammunition cartridge therein, the first end of the first piece 107 and the first end of the second piece 106 are in contact while the second end of the first piece 107 and the second end of the second piece 106 are separated due to the first force exerted by the elastic element 109. Further, when the magazine shell 101 holds one or more ammunition cartridges therein with the one or more ammunition cartridges disposed on the second piece 106, the first end of the first piece 107 and the first end of the second piece 106 may be separated while the one or more ammunition cartridges compress the magazine main spring to exert a second force against the first force exerted by the elastic element 109.

In at least one implementation, the elastic element 109 comprises a compression spring. Alternatively, any other suitable type of elastic device may be utilized in place of a compression spring such as, for example, a coil spring, a spiral torsion spring, a volute spring, a tension spring, a leaf spring, a torsion bar, a hydraulic spring, etc.

As shown in FIG. 2, the second piece 106 has a raised feature 110 to emulate a half side of ammunition. The second piece 106 has a front slope 111 and a back slope 112 for the ease of a bolt and bolt carrier assembly in the firearm to push the follower assembly 103 down and pass on top of the follower assembly 103. On the bottom side of the piece 106, as shown in FIG. 2, there is a hinge hole 113 configured for connecting with the first piece 107. The second piece 106 includes a number of clearance grooves 114 around the side of the second piece 106 to clear a corresponding number of reinforcement bumps formed by the grooves on the sidewalls of the magazine shell 101 and that of the deformable magazine sidewall spring 102. On the bottom side of the piece 106, there is a spring guide protrusion 115 for anchoring the elastic element 109, e.g., a compression spring. The spring guide pillar 115 is positioned corresponding to the pocket portion 121 of the first piece 107 shown in FIG. 3.

The second end of the second piece 106 further includes a protrusion 120, e.g., a back lip, such that the protrusion 120 engages with a bolt catch of the firearm due to the first force exerted by the elastic element 109 and the second force exerted by the magazine main spring 104 when the magazine shell 101 holds no ammunition cartridge therein.

As shown in FIG. 3, the first piece 107 includes a front anti-tilt pillar 116. The first piece 107 also includes matching clearance grooves 117 just like the clearance grooves 114 on the second piece 106. There are two hinge plates 118 on the first piece 107 that are configured to receive the second piece 106 and the hinge pin 108, forming a hinge for the second piece 106 to be pivot-ably coupled to the first piece 107. For example, the two hinge plates 118 may be disposed about less than half way of the total length of the first piece 107 as measured from the front. The pivotal position is carefully selected according to the different centers of gravity of the cartridges of different calibers and their different casing lengths. From the hinge moving towards the back of the first piece 107, the top surface of the first piece 107 is slopped down. The angle of the sloped surface 119, together with the bending angle of the magazine shell 101, determines how many rounds of ammunition the follower assembly 103 can reliably support within the universal magazine 100. On the sloped surface 119, there is a pocket portion 121 and a matching extruded cup 122 on the bottom side to receive the elastic element 109, e.g., a compression spring. For example, a first end of the elastic element 109, as a compression spring, may be received in the pocket portion 121 while a second end of the elastic element 109 that is opposite the first end is coupled to the spring guide protrusion 115 on the second piece 106. On the bottom of the first piece 107, there is a hinge plate 123 that receives the end of the main magazine spring 104 and secures the main magazine spring 104 in place.

When the universal magazine 100 is empty, i.e., holding no ammunition cartridge therein, the follower assembly 103 would function just like any other conventional follower. When one or more ammunition cartridges are inserted into the universal magazine 100, the follower assembly 103 will accordingly sink down inside the universal magazine 100. The first piece 107 does not tilt when the follower assembly 103 moves up and down inside the universal magazine 100. On the other hand, the second piece 106 will self-lever, or self-align, with the one or more ammunition cartridges so that the second piece 106 will provide full support by exerting force on the one or more ammunition cartridges that are in the universal magazine 100. The position of the hinge pin 108 and the spring rate of the elastic element 109 are designed in such a way that the second piece 106 will tilt according to the tapering of the ammunition casing, while allowing the second piece 106 to be in full contact with the casing of the one or more ammunition cartridges. This is how the full support is achieved.

As shown in FIG. 4, the relative position between the stacked ammunition cartridges is changed slightly, compared to that of a stack of ammunition cartridges in a conventional magazine, due to the straight magazine wall of the universal magazine 100.

After the last ammunition leaves the universal magazine 100, the back lip, or the protrusion 120, of the second 106, shown in FIG. 2, will engage with a bolt catch of the firearm under the tension of the elastic element 109 and the tension of the magazine main spring 104. Thus, the bolt catch function is maintained with the disclosed design of the follower assembly 103.

Figure 5:
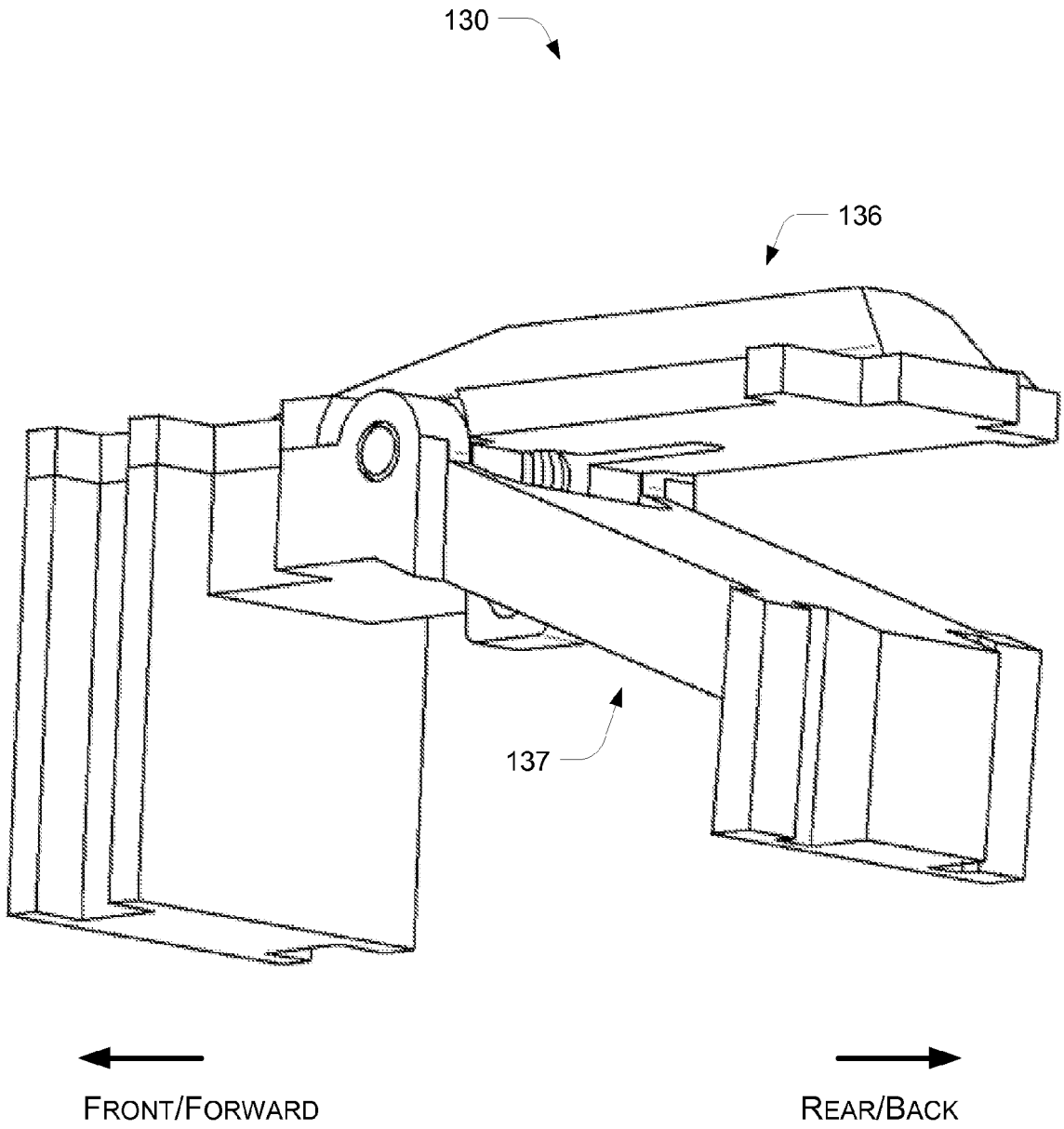
FIG. 5 is an assembly view of a tilt-able self-levering follower assembly of a universal magazine in accordance with another embodiment of the present disclosure.
Figure 6:
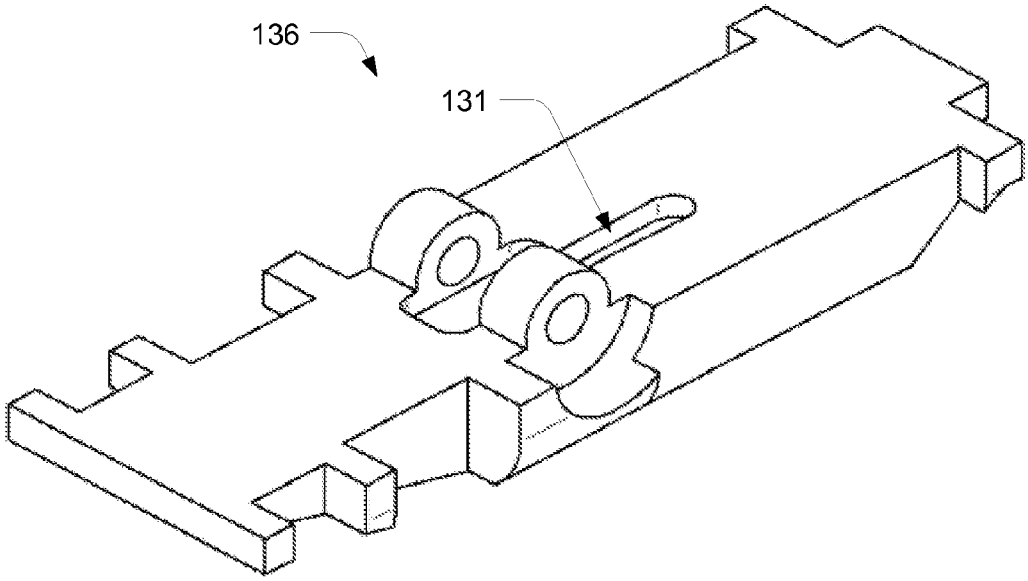
FIG. 6 is a perspective view of a tilt-able piece of the tilt-able self-levering follower assembly of FIG. 5 in accordance with an embodiment of the present disclosure.
Figure 7:
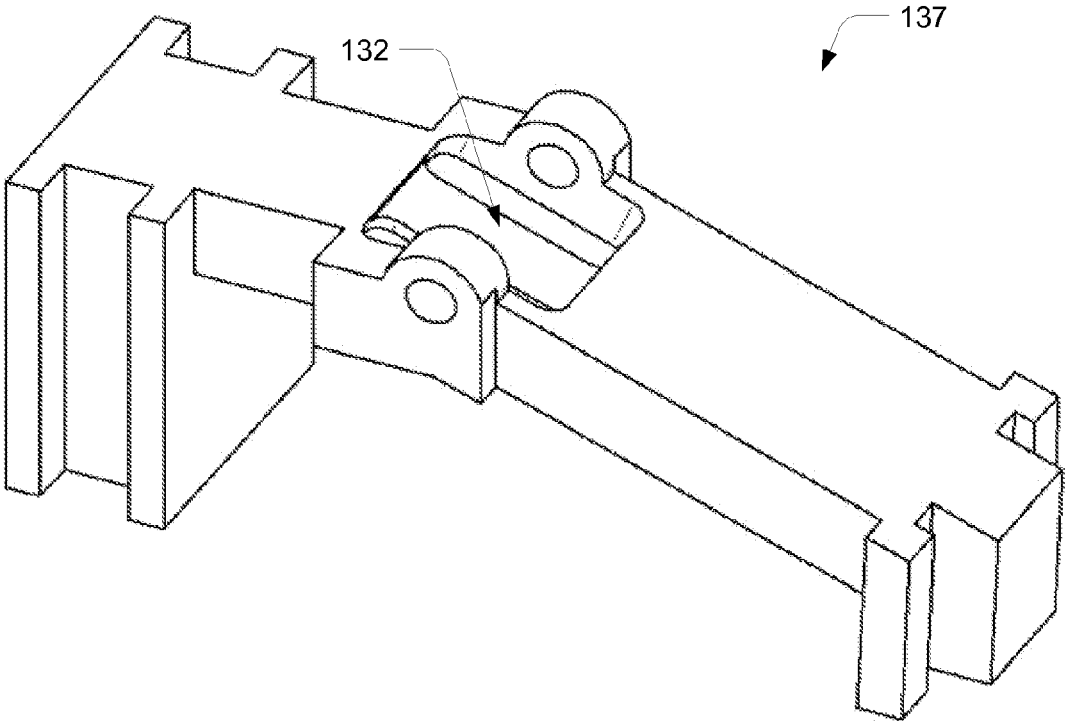
FIG. 7 is a perspective view of a non-tilt-able piece of the tilt-able self-levering follower assembly of FIG. 5 in accordance with an embodiment of the present disclosure.

FIG. 5 illustrates a tilt-able self-levering follower assembly 130 of the universal magazine 100 according to a second embodiment. FIG. 6 illustrates a tilt-able second piece 136 of the tilt-able self-levering follower assembly 130 of FIG. 5. FIG. 7 illustrates a non-tilt-able first piece 137 of the tilt-able self-levering follower assembly 130 of FIG. 5.

In the interest of brevity, features and functions of the first piece 137 and the second piece 136 that are similar to those of the first piece 107 and the second piece 106 will not be repeated. The following description will focus on the differences.

The alternative design as shown in FIGS. 5-7 utilizes a torsion spring for the elastic element 109. The elastic element 109, as a torsion spring, is installed around the hinge hole 113 between the second piece 136 and the first piece 137.

Compared to the second piece 106 as shown in FIG. 2, the second piece 136 of FIG. 6 has an identical design on the top side as that of the second piece 106. The bottom side of the second piece 136, however, does not have the spring guide protrusion 115. Instead, the second piece 136 includes a recess 131 that receives a second portion of the elastic element 109. Compared to the first piece 107 as shown in FIG. 3, the first piece 137 of FIG. 7 has an identical design as that of the second piece 106 with some exceptions. The first piece 137 does not have the pocket portion 121 or the matching extruded cup 122 on the bottom side. Instead, the first piece 137 includes a recess 132 that receives a first portion of the elastic element 109, as a torsion spring.

Figure 8:
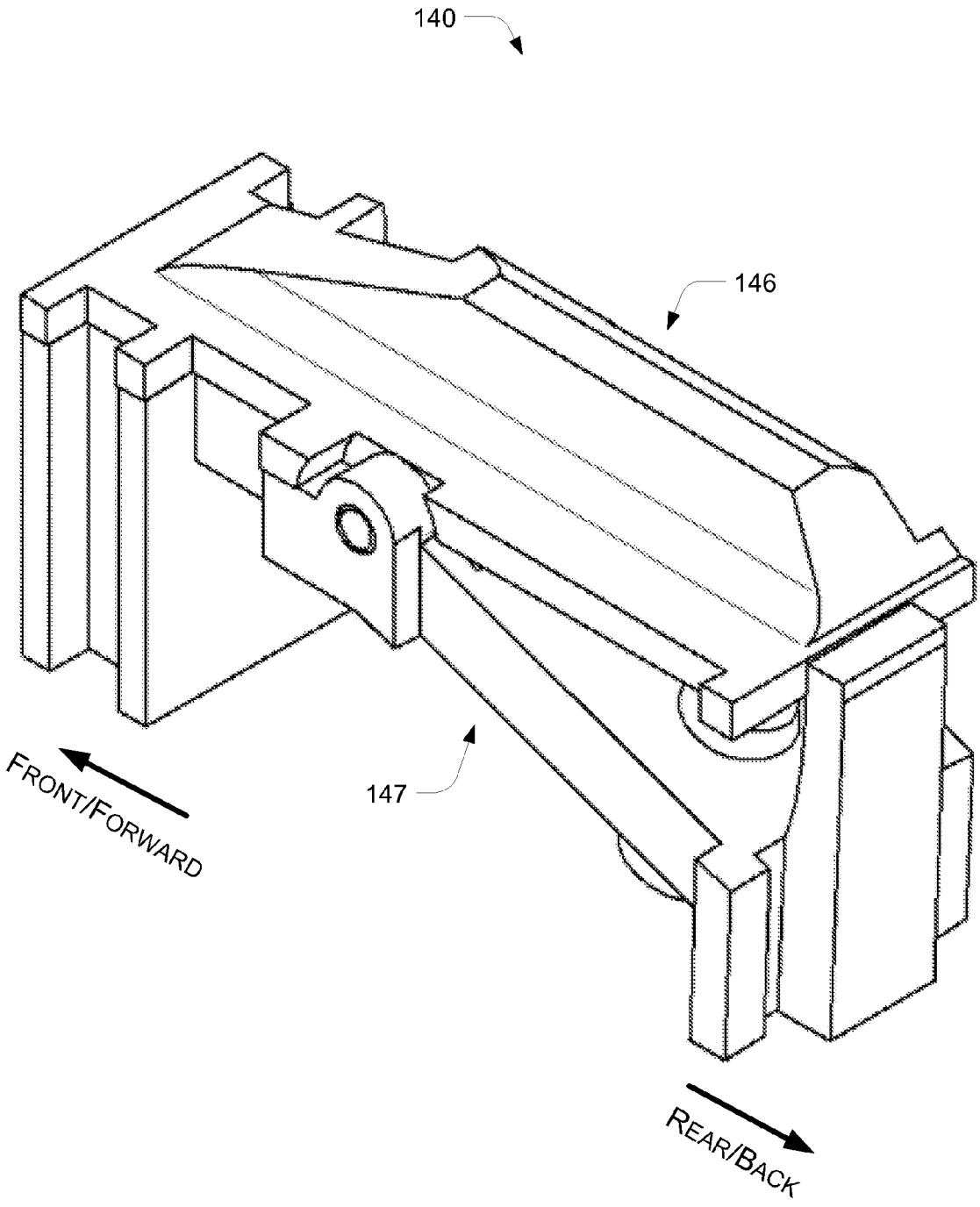
FIG. 8 is a perspective view of a tilt-able self-levering follower assembly in accordance with a further embodiment of the present disclosure.
Figure 9:
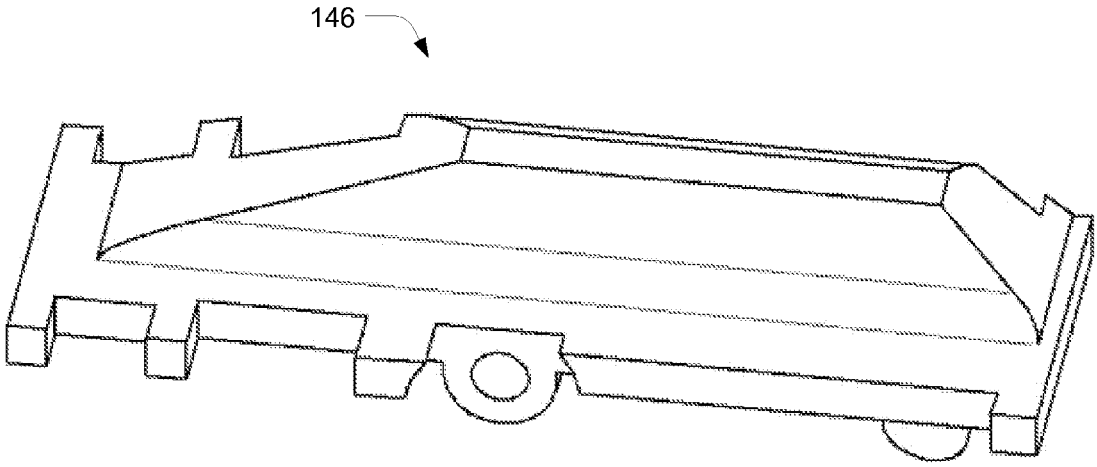
FIG. 9 is a perspective view of a tilt-able piece of the tilt-able self-levering follower assembly of FIG. 8 in accordance with an embodiment of the present disclosure.
Figure 10:
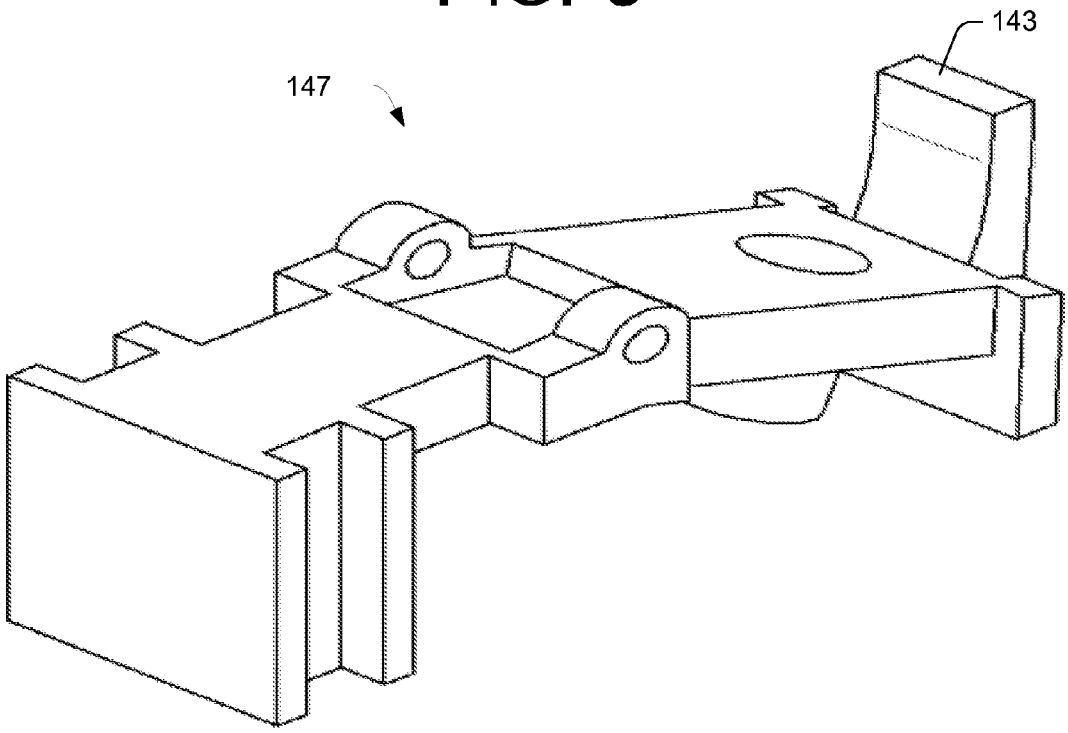
FIG. 10 is a perspective view of a non-tilt-able piece of the tilt-able self-levering follower assembly of FIG. 8 in accordance with an embodiment of the present disclosure.

FIG. 8 illustrates a tilt-able self-levering follower assembly 140 of the universal magazine 100 according to a third embodiment. FIG. 9 illustrates a tilt-able second piece 146 of the tilt-able self-levering follower assembly 140 of FIG. 8. FIG. 10 illustrates a non-tilt-able first piece 147 of the tilt-able self-levering follower assembly 140 of FIG. 8.

The design shown in FIGS. 8-10 may utilize a compression spring as the design shown in FIGS. 1-3. Alternatively, the design shown in FIGS. 8-10 may utilize a torsion spring as the design shown in FIGS. 5-7.

In the interest of brevity, features and functions of the first piece 147 and the second piece 146 that are similar to those of the first piece 107 and the second piece 106 will not be repeated. The following description will focus on the differences.

Compared to the second piece 106 as shown in FIG. 2, the second piece 146 of FIG. 9 has an identical design as that of the second piece 106 except that the second piece 146 does not have the back lip, or protrusion 120. Compared to the first piece 107 as shown in FIG. 3, the first piece 147 of FIG. 10 has an identical design as that of the second piece 106 except that the back side of the first piece 147 is extended to form a back lip, or a protrusion 143. The protrusion 143 may engage with a bolt catch of the firearm due to the second force exerted by the main magazine spring 104 when the magazine shell 101 holds no ammunition cartridge therein. This change will enhance the anti-tilt function of the first piece 147 and maintain the bolt catch function that was previously associated with the second piece 146 in the other designs.

Figure 11:
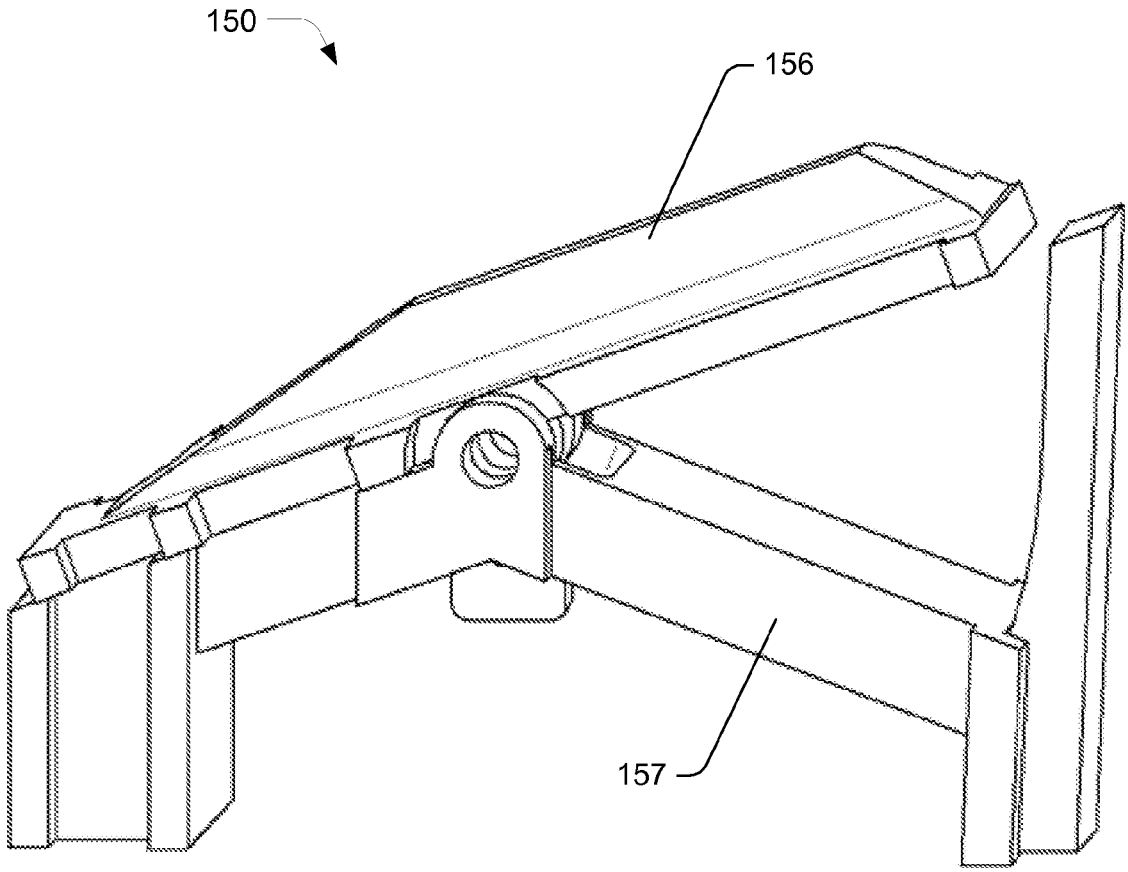
FIG. 11 is a perspective view of a tilt-able self-levering follower assembly in accordance with another embodiment of the present disclosure.
Figure 12:
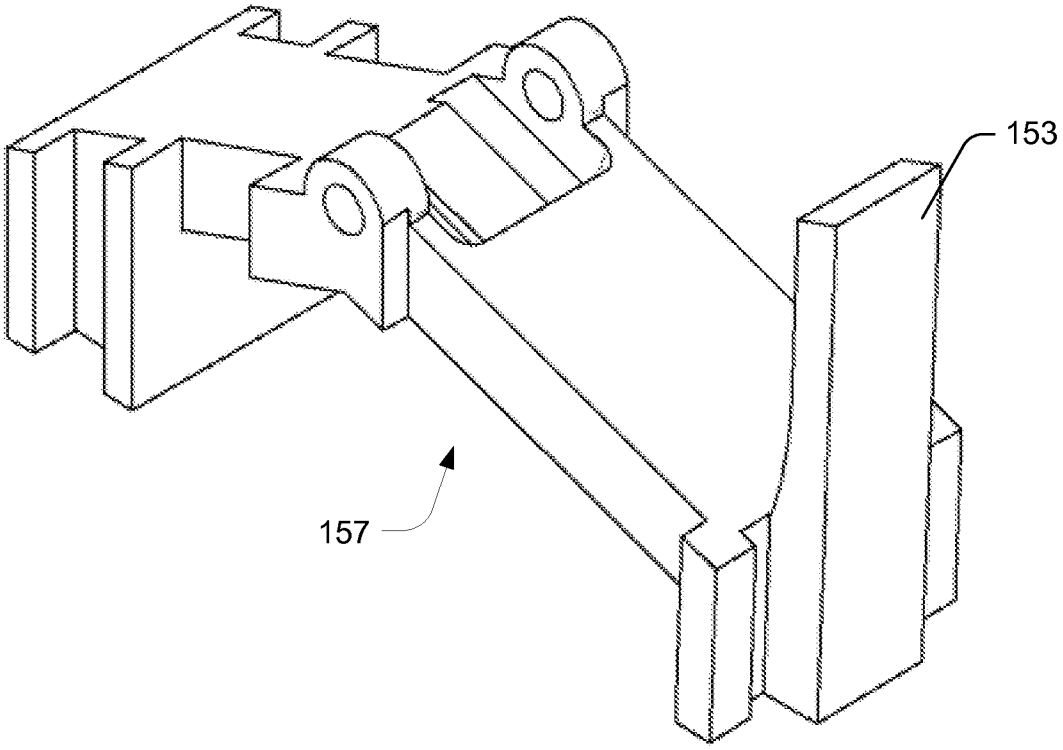
FIG. 12 is a perspective view of a non-tilt-able piece of the tilt-able self-levering follower assembly of FIG. 11 in accordance with an embodiment of the present disclosure.

FIG. 11 illustrates a tilt-able self-levering follower assembly 150 of the universal magazine 100 according to a fourth embodiment. FIG. 12 illustrates a non-tilt-able first piece 157 of the tilt-able self-levering follower assembly 150 of FIG. 11.

As shown in FIG. 11, the follower assembly 150 includes a first piece 157 and a second piece 156. The first piece 157 is a non-tilt-able piece while the second piece 156 is a tilt-able piece. In the interest of brevity, features and functions of the first piece 157 and the second piece 156 that are similar to those of the first piece 107, 137, 147 and the second piece 106, 136, 146 will not be repeated. The following description will focus on the differences.

Compared to the first piece 147 as shown in FIG. 10 and first piece 137 as shown in FIG. 7, the first piece 157 of FIG. 12 has similar design such as the protrusion 153, corresponding to the protrusion 143. Similarly, the middle section of 157 may be identical to that of the 137 due to both use of torsion spring. However, the front section of the 157 is shaped to have a downward slope such that the tilt-able piece 156 can be tilted downward and have more rotational travel compare to all other second piece disclosed before. The second piece 156 may be identical to 136 except the rear due to both use of torsion spring. However, the rear of 156 may be identical to that of 146.

Conclusion

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims and their equivalents.

What is claimed is:

1. A self-levering follower assembly for a magazine for a firearm, the follower assembly disposable inside a magazine shell of the magazine and movable generally along a longitudinal axis of the magazine shell, the follower assembly comprising:

a first piece configured to be coupled to an end of a main magazine spring of the magazine, the first piece having a first end and a second end opposite the first end;

a second piece having a first end and a second end opposite the first end, a middle portion of the second piece pivot-ably coupled to a middle portion of the first piece; and an elastic element elastically disposed between the first piece and the second piece and exerting a first force on the first piece and the second piece such that:

when the magazine shell holds no ammunition cartridge therein, the first end of the first piece and the first end of the second piece are in contact while the second end of the first piece and the second end of the second piece are separated due to the first force exerted by the elastic element, and when the magazine shell holds one or more ammunition cartridges therein with the one or more ammunition cartridges disposed on the second piece, the first end of the first piece and the first end of the second piece are either in contact or separated while the one or more ammunition cartridges compress the main magazine spring to exert a second force against the first force exerted by the elastic element.

2. A self-levering follower assembly of claim 1, wherein the second end of the second piece includes a protrusion such that the protrusion is configured to engage with a bolt catch of the firearm due to the first force exerted by the elastic element and the second force exerted by the magazine main spring when the magazine shell holds no ammunition cartridge therein.

3. A self-levering follower assembly of claim 1, wherein the second end of the first piece includes a protrusion such that the protrusion is configured to engage with a bolt catch of the firearm due to the second force exerted by the magazine main spring when the magazine shell holds no ammunition cartridge therein.

4. A self-levering follower assembly of claim 1, wherein the elastic element comprises a compression spring.

5. A self-levering follower assembly of claim 4, wherein the first piece includes a pocket portion that receives a first end of the compression spring, and wherein the second piece includes a spring guide protrusion to which a second end of the compression spring opposite the first end of the compression spring is coupled.

6. A self-levering follower assembly of claim 1, wherein the elastic element comprises a torsion spring.

7. A self-levering follower assembly of claim 6, wherein the first piece includes a recess that receives a first portion of the torsion spring, and wherein the second piece includes a recess that receives a second portion of the torsion spring.

8. A magazine for a firearm, comprising:

a magazine shell having a first end, a second end opposite the first end, and sidewalls between the first end and the second end, the first end having an opening and configured to attach to the firearm, the second end including a bottom plate;

a main magazine spring having a first end and a second end opposite the first end, the second end of the main magazine spring coupled to the bottom plate of the second end of the magazine shell; and a self-levering follower assembly disposed inside the magazine shell and movable generally along a longitudinal axis of the magazine shell, the follower assembly including:

a first piece coupled to the first end of the main magazine spring, the first piece having a first end and a second end opposite the first end, a second piece having a first end and a second end opposite the first end, a middle portion of the second piece pivot-ably coupled to a middle portion of the first piece, and an elastic element elastically disposed between the first piece and the second piece and exerting a first force on the first piece and the second piece.

9. A magazine of claim 8, wherein:

when the magazine shell holds no ammunition cartridge therein, the first end of the first piece and the first end of the second piece are in contact while the second end of the first piece and the second end of the second piece are separated due to the first force exerted by the elastic element; and when the magazine shell holds one or more ammunition cartridges therein with the one or more ammunition cartridges disposed on the second piece, the first end of the first piece and the first end of the second piece are either in contact or separated while the one or more ammunition cartridges compress the magazine main spring to exert a second force against the first force exerted by the elastic element.

10. A magazine of claim 8, wherein the second end of the second piece includes a protrusion such that the protrusion is configured to engage with a bolt catch of the firearm due to the first force exerted by the elastic element and the second force exerted by the main magazine spring when the magazine shell holds no ammunition cartridge therein.

11. A magazine of claim 8, wherein the second end of the first piece includes a protrusion such that the protrusion is configured to engage with a bolt catch of the firearm due to the second force exerted by the magazine main spring when the magazine shell holds no ammunition cartridge therein.

12. A magazine of claim 8, wherein the elastic element comprises a compression spring.

13. A magazine of claim 12, wherein the first piece includes a pocket portion that receives a first end of the compression spring, and wherein the second piece includes a spring guide protrusion to which a second end of the compression spring opposite the first end of the compression spring is coupled.

14. A magazine of claim 8, wherein the elastic element comprises a torsion spring.

15. A magazine of claim 14, wherein the first piece includes a recess that receives a first portion of the torsion spring, and wherein the second piece includes a recess that receives a second portion of the torsion spring.

* * * * *